US006527596B1

(12) United States Patent
Su

(10) Patent No.: US 6,527,596 B1
(45) Date of Patent: Mar. 4, 2003

(54) PLUG BLADE STRUCTURE WITH A SHALLOW RECESS AND A REINFORCED GUIDE SLOT FOR FORMING AN INSULATING LAYER

(76) Inventor: Tun Li Su, Chang Chia Wei, P.O. Box 25-7, Kaohsiung City 811 (TW)

( * ) Notice: Subject to any disclaimer, the term of this patent is extended or adjusted under 35 U.S.C. 154(b) by 0 days.

(21) Appl. No.: 10/060,383

(22) Filed: Feb. 1, 2002

(51) Int. Cl.[7] ..... H01R 13/04
(52) U.S. Cl. ..... 439/693
(58) Field of Search ..... 439/693, 736, 439/604–606

(56) References Cited

U.S. PATENT DOCUMENTS 2,537,370 A * 1/1951 Parnes ..... 439/693
3,533,052 A * 10/1970 Degaetano ..... 439/693
3,710,287 A * 1/1973 Eckert ..... 439/693
5,641,311 A * 6/1997 Chuang ..... 439/693
6,109,977 A * 8/2000 Baxter et al. ..... 439/693

* cited by examiner

*Primary Examiner*—Gary Paumen

(57) ABSTRACT

A plug blade structure comprises an enclosed section and an exposed section. The exposed section includes a wider front section and a narrower rear section. The enclosed section includes a shallow recess in a front end thereof for filling molten plastic material into the narrower rear section. A transverse through-hole extends from a face of the narrower rear section to the other face of the narrower rear section. A reinforcing guide slot is defined in the narrower rear section and communicated with the transverse through-hole. The transverse through-hole and the reinforcing guide slot guide the molten plastic material from a face of the narrower rear section to the other face of the narrower rear section such that the air on the faces of the metal blade can be well expelled to thereby allow smooth injection and that the resultant insulting layer formed on the narrower rear section has flush surfaces.

3 Claims, 17 Drawing Sheets

PLUG BLADE STRUCTURE WITH A SHALLOW RECESS AND A REINFORCED GUIDE SLOT FOR FORMING AN INSULATING LAYER

BACKGROUND OF THE INVENTION

1. Field of the Invention

The present invention relates to a plug blade structure with a shallow recess and a reinforced guide slot for forming an insulating layer, thereby preventing generation of a fault on an outer surface of the insulating layer.

2. Description of the Related Art

A plug is a necessary element to all industries and other fields. The plug is engaged with a socket to supply electricity to an electric appliance or other electric equipments.

Most advanced countries require each blade of the plug to be partially wrapped by an insulating layer at an exposed section thereof, thereby avoiding electric shocks to the user. The insulating layer is generally made of plastic material and wraps a portion of the exposed section of the blade by means of injection molding. However, the insulating layer is apt to be disengaged from the smooth metal surface of the blade as a result of poor bonding force therebetween. Thus, the insulating layer would slide easily, and sometimes may even fall. The blade is then exposed again and thus could cause an electric shock.

It has been proposed to provide a plug blade including an enclosed section and an exposed section. The exposed section includes a wider front section and a narrower rear section having a transverse through-hole. Plastic material is filled to a face of the narrower rear section and flows through the transverse through-hole to the other face of the narrower rear section. An insulating layer is formed on the narrower rear section after hardening of the plastic material. The bonding force between the insulating layer and the narrower rear section is improved, and the time for filling the plastic material is reduced. Soviet Union Pat. No. SU 1388,969-A discloses a similar structure. However, a fault (generally a shallow recess) is formed on a surface of the insulating layer after hardening of the plastic material. The appearance of the plug is thus adversely affected.

SUMMARY OF THE INVENTION

An object of the present invention is to provide a plug blade structure to provide an aesthetic appearance in the insulating layer after formation.

A plug blade structure in accordance with the present invention comprises an enclosed section and an exposed section. The exposed section includes a wider front section and a narrower rear section. The enclosed section includes a shallow recess in a front end thereof for filling molten plastic material into the narrower rear section. A transverse through-hole extends from a face of the narrower rear section to the other face of the narrower rear section. A reinforcing guide slot is defined in the narrower rear section and communicated with the transverse through-hole. The transverse through-hole and the reinforcing guide slot guide the molten plastic material from a face of the narrower rear section to the other face of the narrower rear section.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
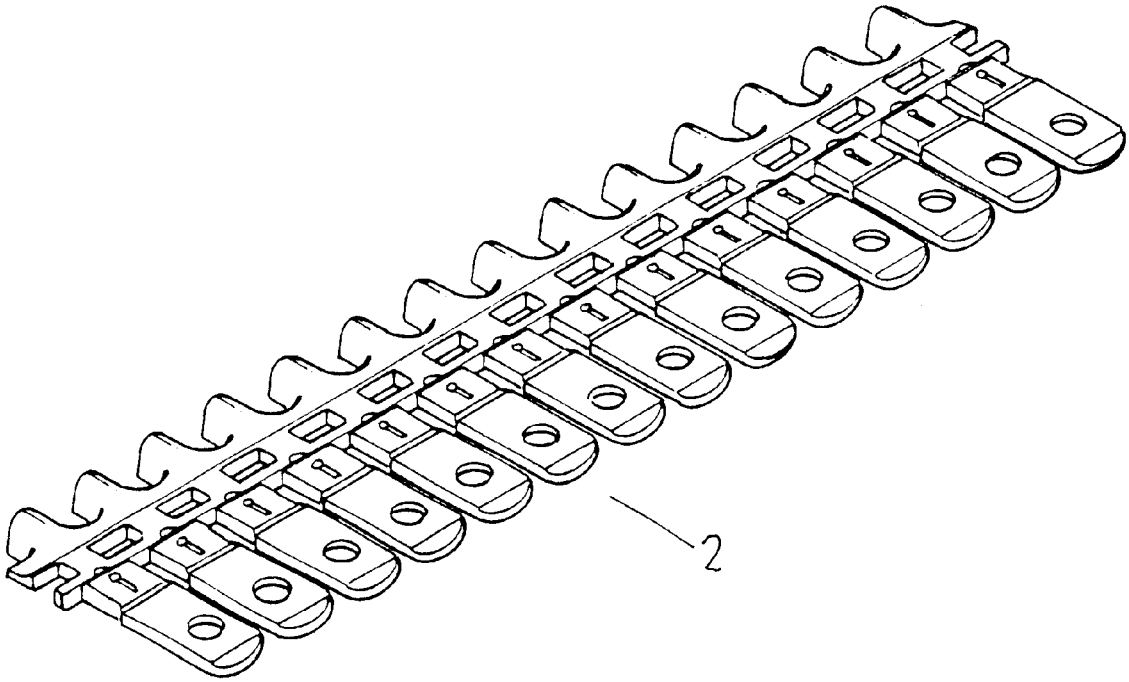
FIG. 1 is a perspective view of a row of plug blades in accordance with a first embodiment of the present invention.
Figure 4:
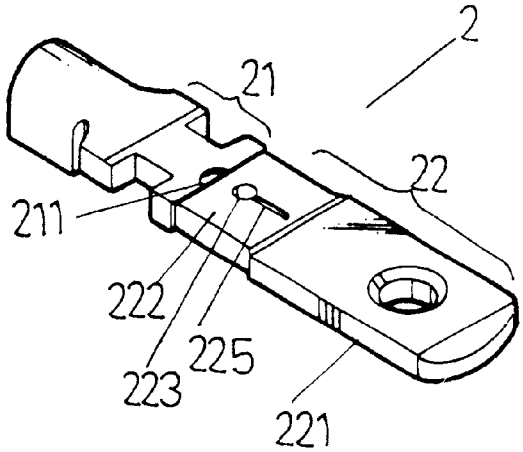
FIG. 4 is a perspective view of a plug blade structure in accordance with the first embodiment.
Figure 10:
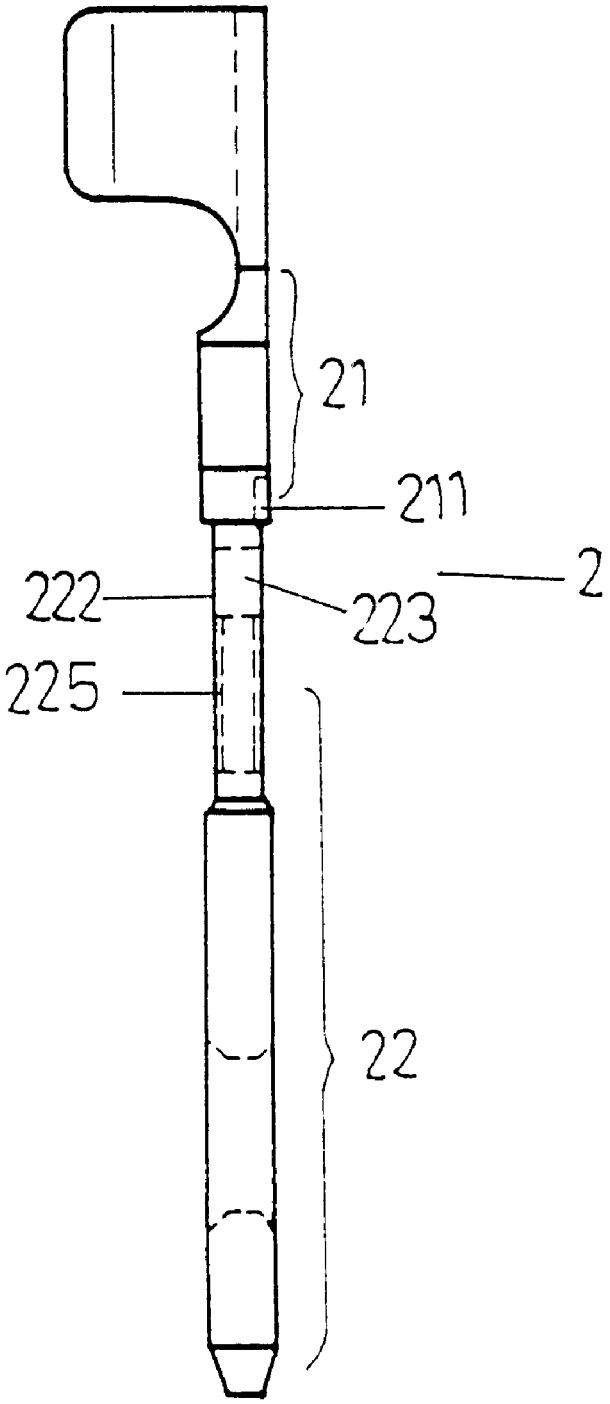
FIG. 10 is a side view of the plug blade structure in accordance with the first embodiment.
Figure 17:
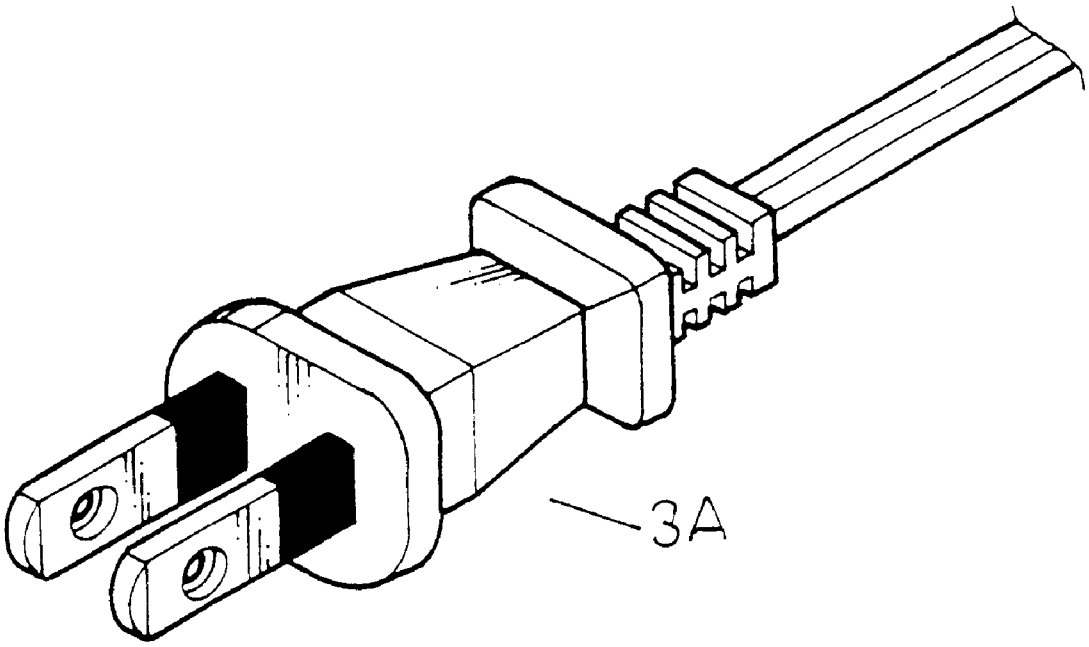
FIG. 17 is a perspective view of a plug made from the plug blade structure in accordance with the present invention.
Figure 18:
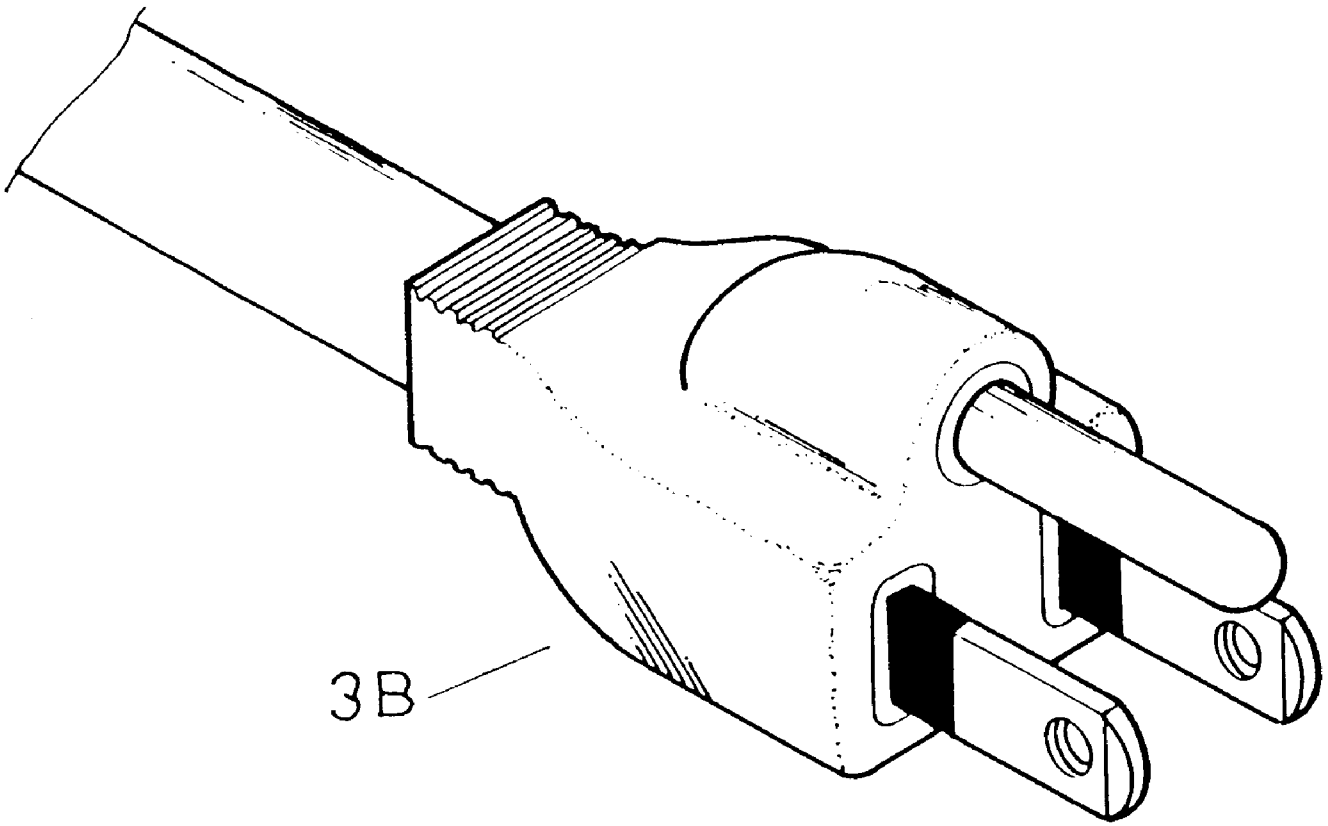
FIG. 18 is a perspective view of another plug made from the plug blade structure in accordance with the present invention.

Referring to FIGS. 4 and 10, a plug blade structure 2 in accordance with the present invention is cut from a row of plug blades 2 in FIG. 1 and includes an enclosed section 21 to be enclosed by a housing 23 (FIG. 26) of a final plug 3A (FIG. 17) and an exposed section 22. The exposed section 22 includes a wider front section 221 and a narrower rear section 222. A transverse through-hole 223 extends from a face of the narrower rear section 222 to the other face of the narrower rear section 222. A reinforcing guide slot 225 is defined in the narrower rear section 222 and communicated with the transverse through-hole 223. Also, the reinforcing guide slot 225 extends from a face of the narrower rear section 222 to the other face of the narrower rear section 222. The enclosed section 21 includes a shallow recess 211 in a front end thereof for filling molten plastic material into the narrower rear section 224. The faces of the narrower rear section 222 are lower than those of the wider front section 221, and two lateral sides of the narrower rear section 222 are lower than those of the wider front section 221. Alternatively, the faces of the narrower rear section 222 are flush with those of the wider front section 221.

Figure 11:
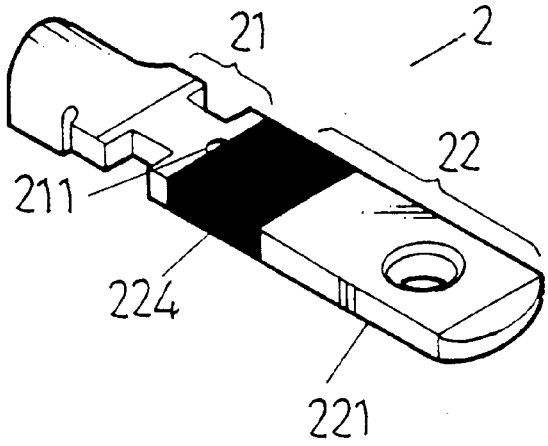
FIG. 11 is a perspective view of a plug blade made from the plug blade structure in accordance with the first embodiment, the plug blade having an insulating layer formed thereon.
Figure 24:
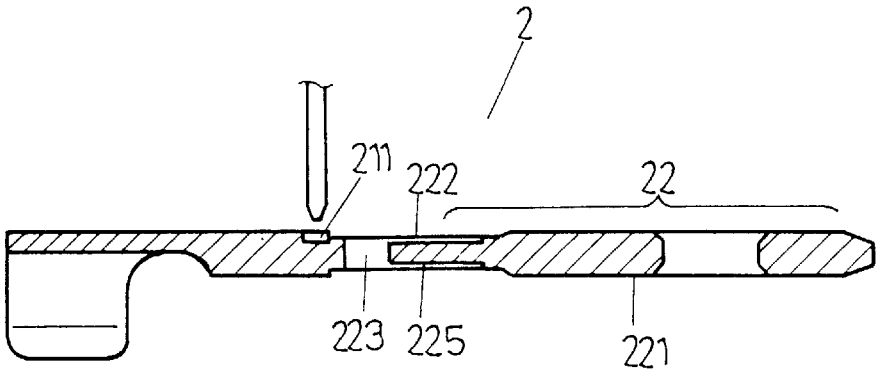
FIG. 24 is a schematic sectional view illustrating a filling procedure of molten plastic material to the plug blade structure in accordance with the present invention.
Figure 25:
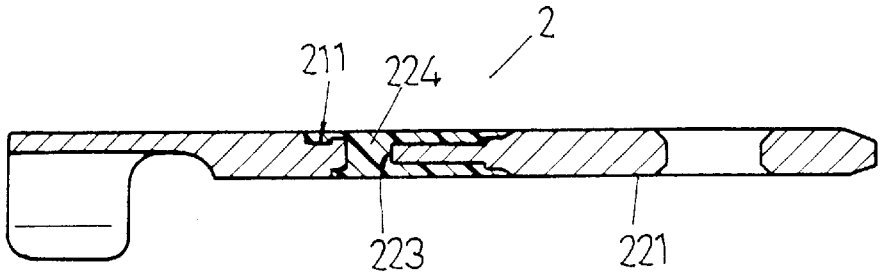
FIG. 25 is a schematic sectional view illustrating formation of the insulating layer on the plug blade in accordance with the present invention.
Figure 26:
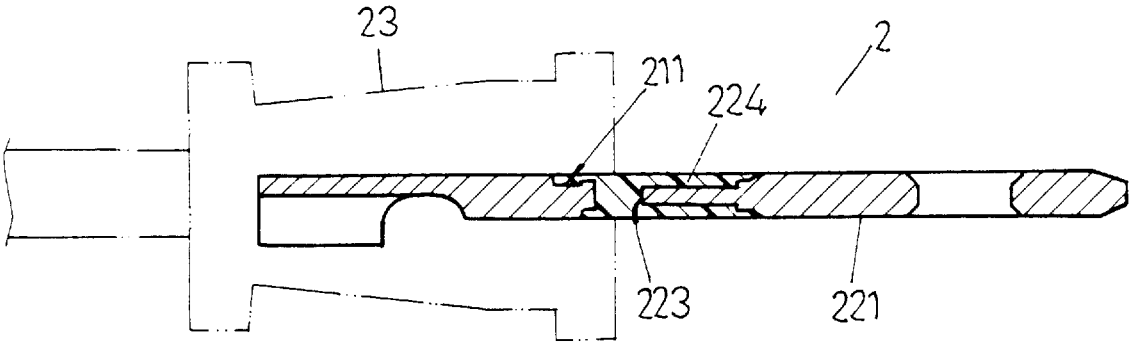
FIG. 26 is a schematic sectional view similar to FIG. 25, illustrating formation of a plug housing.

An insulating layer 224 is formed on the narrower rear section 222, as shown in FIG. 11. Referring to FIG. 24, molten plastic material is filled into the narrower rear section 222 via the shallow recess 211. The molten plastic material flows from a face to the other face of the narrower rear section 222 via the transverse through-hole 223 and the slot 225, as shown in FIG. 25. The insulating layer 220 with flush surfaces is formed after hardening of the plastic material, as shown in FIG. 11. Next, two or three of the plug blades 2 in FIG. 25 can be placed into a mold, and plastic material is injected into the mold to form a final plug 3A (FIG. 17) with a housing 23 (FIG. 26). The shallow recess 211 may be semi-circular or rectangular.

The fault resulting from the formation of the insulating layer is located in a position adjacent to the shallow recess 211 for filling the molten plastic material. Nevertheless, the shallow recess 211 is enclosed by the housing 23 after formation of the whole plug 3A. Thus, the appearance of the insulating layer 220 is not adversely affected. Further, due to provision of the reinforcing guide slot 225 communicated with the transverse through-hole 223, the air on the faces of the metal blade can be well expelled such that the injection molding may proceed smoothly, and the molten plastic material flowing randomly on the faces of the metal blades may flow from one face to the other of each metal blade.

Figure 2:
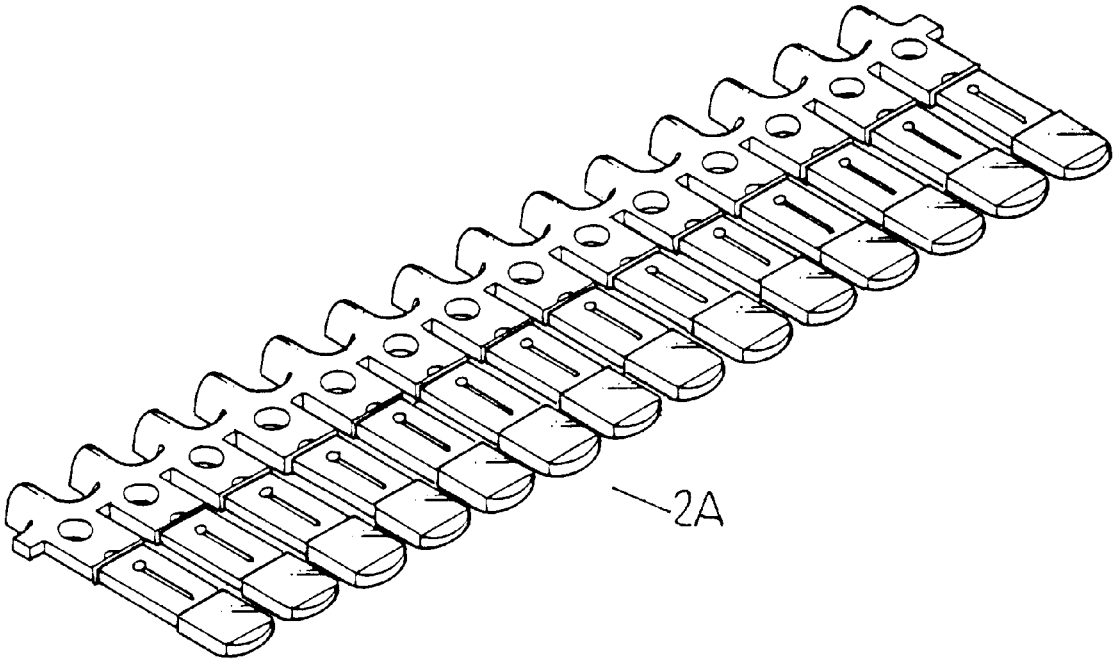
FIG. 2 is a perspective view of a row of plug blades in accordance with a second embodiment of the present invention.
Figure 5:
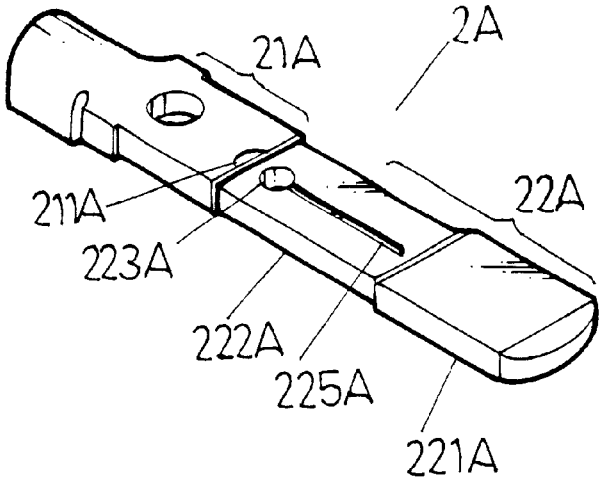
FIG. 5 is a perspective view of a plug blade structure in accordance with the second embodiment.

FIG. 5 illustrates another type of the plug blade structure 2A that is cut from a row of plug blades 2A in FIG. 2 and includes an enclosed section 21A to be enclosed by a housing of a plug and an exposed section 22A. The exposed section 22A includes a wider front section 221A and a narrower rear section 222A. A transverse through-hole 223A extends from a face of the narrower rear section 222A to the other face of the narrower rear section 222A. A reinforcing guide slot 225A is defined in the narrower rear section 222A and communicated with the transverse through-hole 223A. Also, the reinforcing guide slot 225A extends from a face of the narrower rear section 222A to the other face of the narrower rear section 222A. The enclosed section 21A includes a shallow recess 211A in a front end thereof for filling plastic material into the narrower rear section 224A. The faces of the narrower rear section 222A are lower than those of the wider front section 221A, and two lateral sides of the narrower rear section 222A are lower than those of the wider front section 221A. Alternatively, the faces of the narrower rear section 222A are flush with those of the wider front section 221A.

Figure 12:
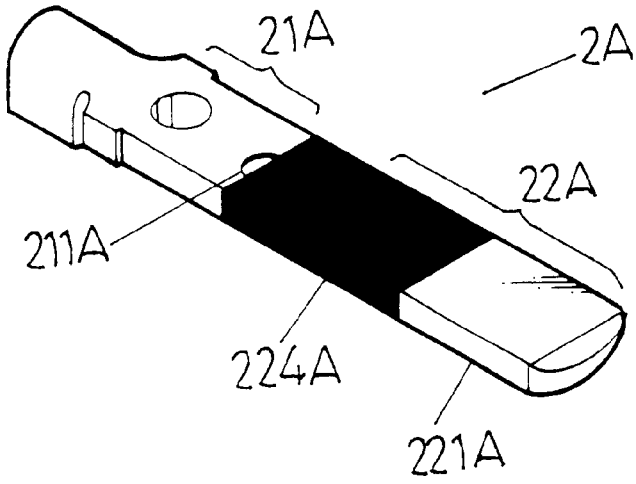
FIG. 12 is a perspective view of a plug blade made from the plug blade structure in accordance with the second embodiment, the plug blade having an insulating layer formed thereon.

An insulating layer 224A is formed on the narrower rear section 222A, as shown in FIG. 12. Formation of the insulating layer 224A and the subsequent housing 23 of the final plug is identical to that of the first embodiment with reference to FIGS. 24 through 26.

Figure 3:
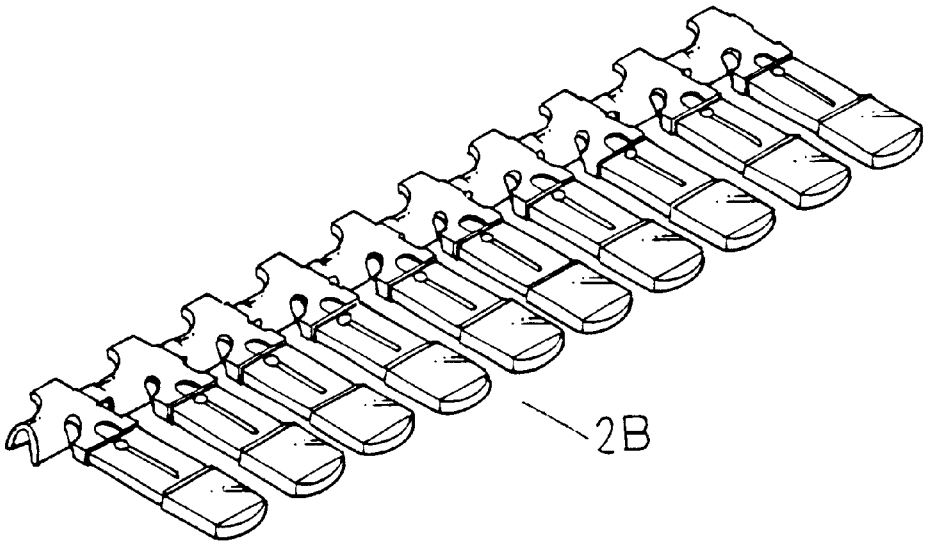
FIG. 3 is a perspective view of a row of plug blades in accordance with a third embodiment of the present invention.
Figure 6:
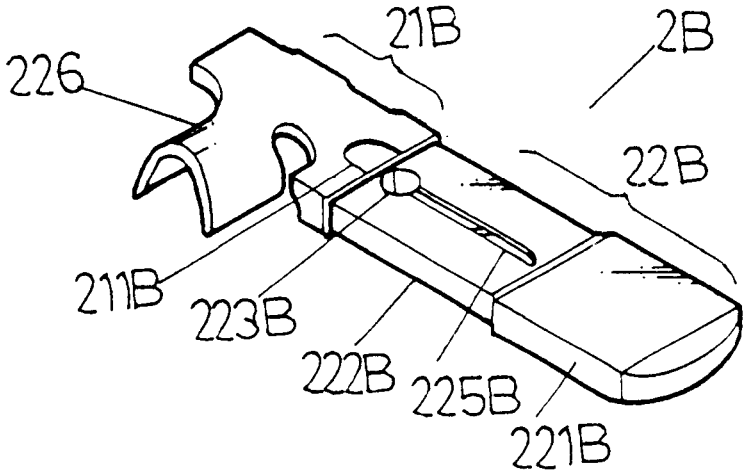
FIG. 6 is a perspective view of a plug blade structure in accordance with the third embodiment.
Figure 19:
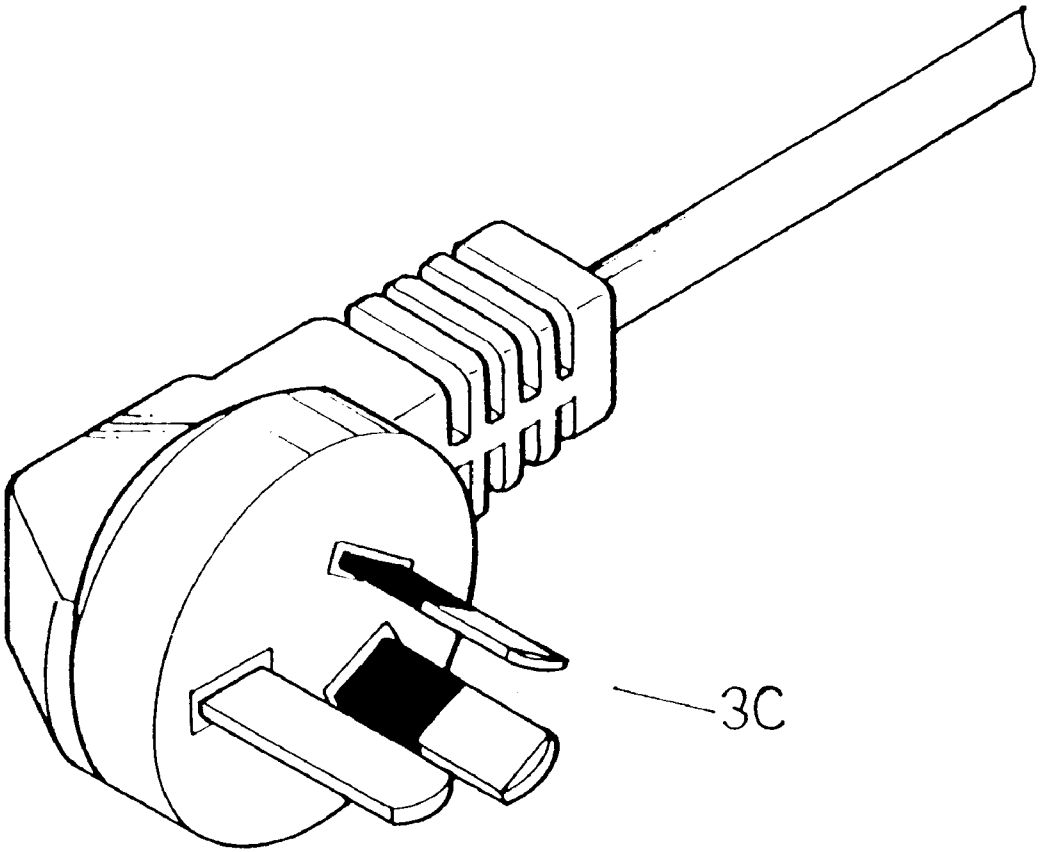
FIG. 19 is a perspective view of a further plug made from the plug blade structure in accordance with the present invention.
Figure 20:
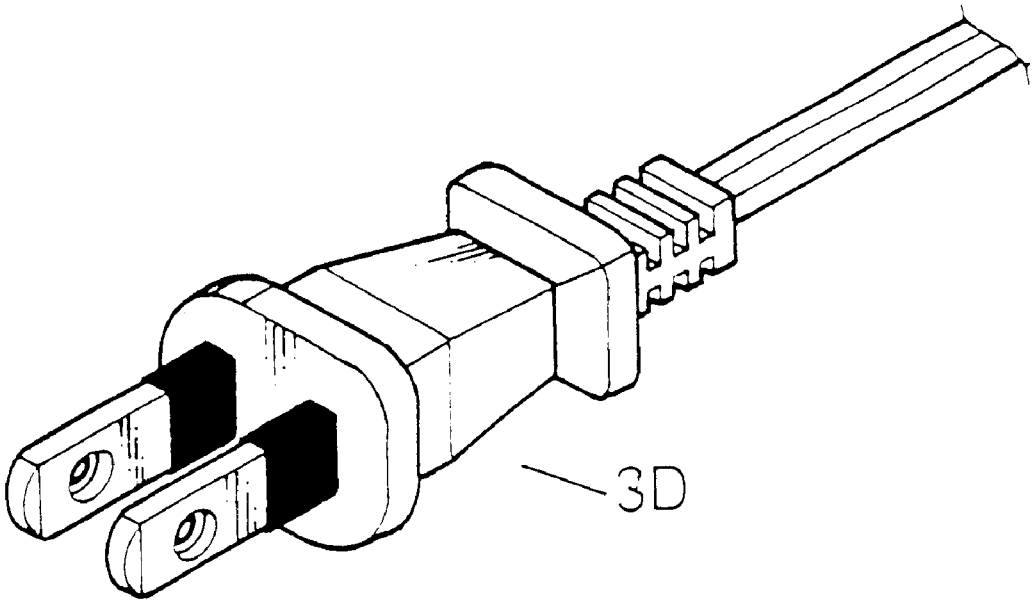
FIG. 20 is a perspective view of still another plug made from the plug blade structure in accordance with the present invention.
Figure 21:
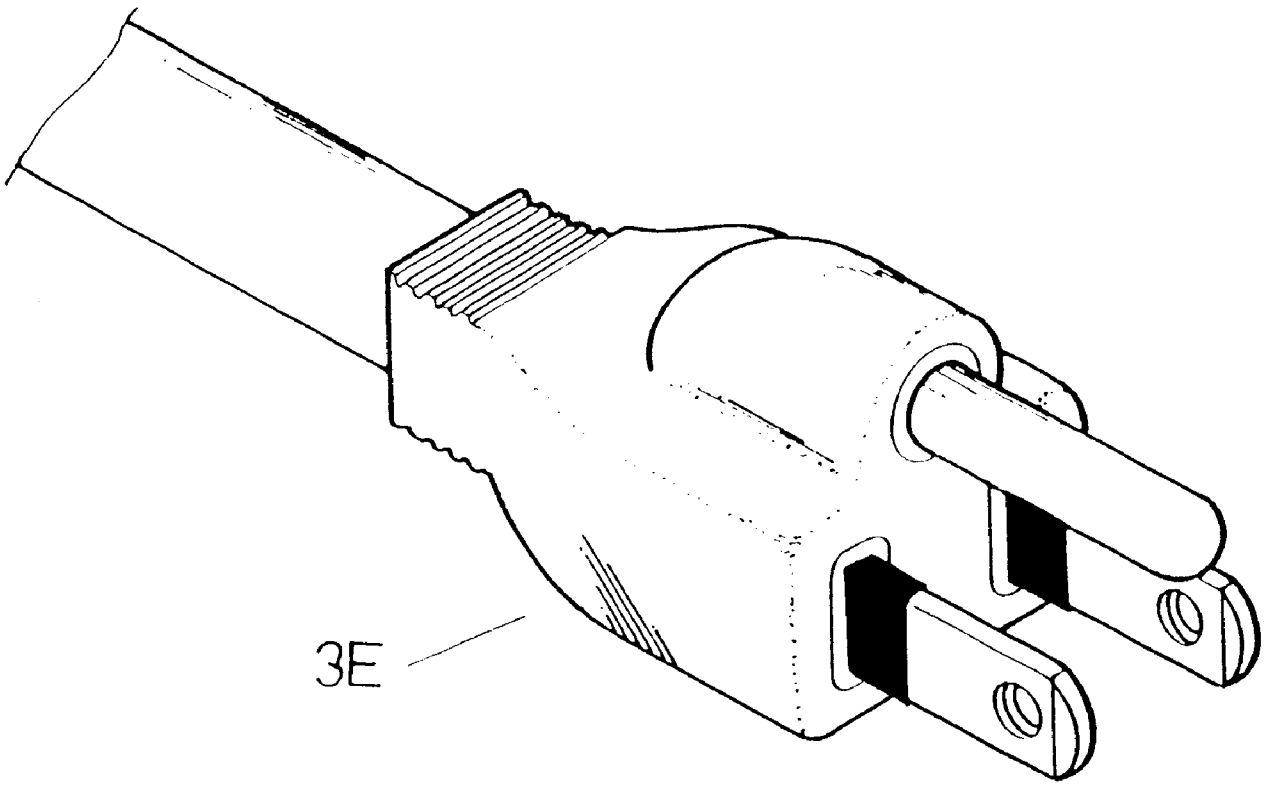
FIG. 21 is a perspective view of yet another plug made from the plug blade structure in accordance with the present invention.

FIG. 6 illustrates a further type of the plug blade structure 2B that is cut from a row of plug blades 2B in FIG. 3 and includes an enclosed section 21B to be enclosed by a housing of a plug and an exposed section 22B. In this embodiment, the plug blade structure 2B includes a wire-receiving groove 226 that is perpendicular to a longitudinal direction of the plug blade structure 2B for producing a plug 3C shown in FIG. 19.

The exposed section 22B includes a wider front section 221B and a narrower rear section 222B. A transverse through-hole 223B extends from a face of the narrower rear section 222B to the other face of the narrower rear section 222B. A reinforcing guide slot 225B is defined in the narrower rear section 222B and communicated with the transverse through-hole 223B. Also, the reinforcing guide slot 225B extends from a face of the narrower rear section 222B to the other face of the narrower rear section 222B. The enclosed section 21B includes a shallow recess 211B in a front end thereof for filling plastic material into the narrower rear section 224B. The faces of the narrower rear section 222B are lower than those of the wider front section 221B, and two lateral sides of the narrower rear section 222B are lower than those of the wider front section 221B. Alternatively, the faces of the narrower rear section 222B are flush with those of the wider front section 221B.

Figure 13:
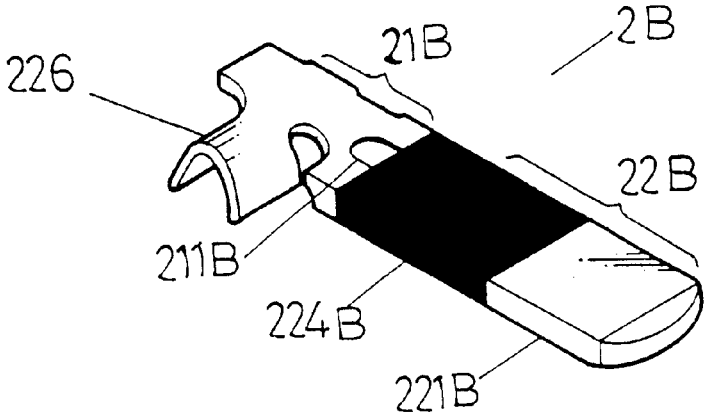
FIG. 13 is a perspective view of a plug blade made from the plug blade structure in accordance with the third embodiment, the plug blade having an insulating layer formed thereon.

An insulating layer 224B is formed on the narrower rear section 222B, as shown in FIG. 13. Formation of the insulating layer 224B and the subsequent housing 23 of the final plug is identical to that of the first embodiment with reference to FIGS. 24 through 26.

Figure 7:
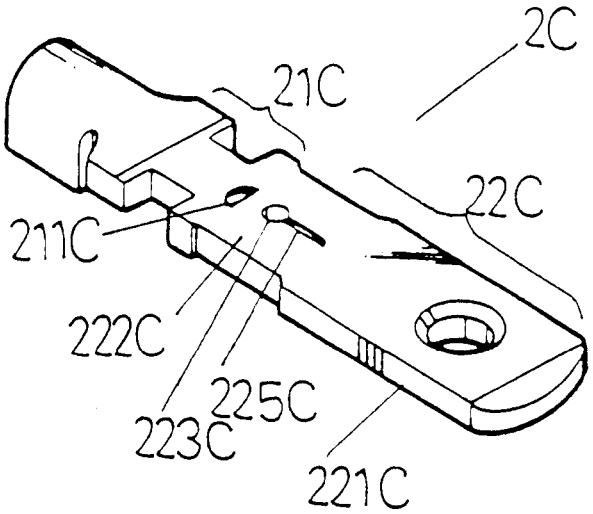
FIG. 7 is a perspective view of a plug blade structure in accordance with a fourth embodiment of the present invention.

FIG. 7 illustrates still another type of the plug blade structure 2C that is cut from a row of plug blades (not shown) and includes an enclosed section 21C to be enclosed by a housing of a plug and an exposed section 22C. The exposed section 22C includes a wider front section 221C and a narrower rear section 222C. A transverse through-hole 223C extends from a face of the narrower rear section 222C to the other face of the narrower rear section 222C. A reinforcing guide slot 225C is defined in the narrower rear section 222C and communicated with the transverse through-hole 223C. Also, the reinforcing guide slot 225C extends from a face of the narrower rear section 222C to the other face of the narrower rear section 222C. The enclosed section 21C includes a shallow recess 211C in a front end thereof for filling plastic material into the narrower rear section 224C. The faces of the narrower rear section 222C are lower than those of the wider front section 221C, and two lateral sides of the narrower rear section 222C are lower than those of the wider front section 221C. Alternatively, the faces of the narrower rear section 222C are flush with those of the wider front section 221C.

Figure 14:
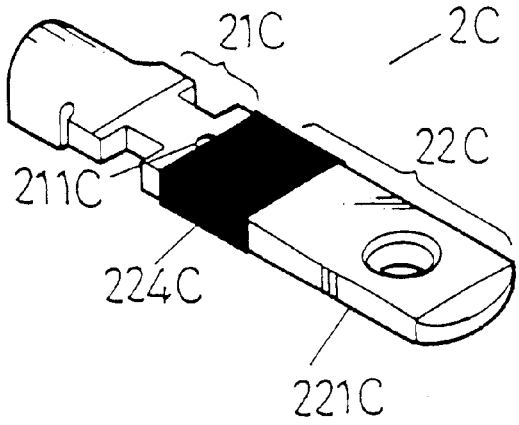
FIG. 14 is a perspective view of a plug blade made from the plug blade structure in accordance with the fourth embodiment, the plug blade having an insulating layer formed thereon.

An insulating layer 224C is formed on the narrower rear section 222C, as shown in FIG. 14. Formation of the insulating layer 224C and the subsequent housing 23 of the final plug is identical to that of the first embodiment with reference to FIGS. 24 through 26.

Figure 8:
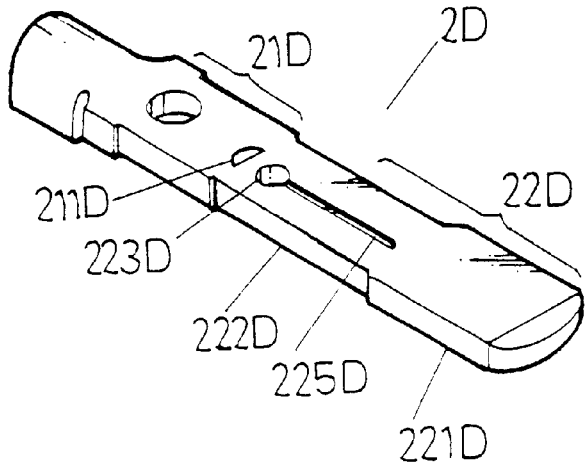
FIG. 8 is a perspective view of a plug blade structure in accordance with a fifth embodiment of the present invention.

FIG. 8 illustrates yet another type of the plug blade structure 2D that is cut from a row of plug blades (not shown) and includes an enclosed section 21D to be enclosed by a housing of a plug and an exposed section 22D. The exposed section 22D includes a wider front section 221D and a narrower rear section 222D. A transverse through-hole 223D extends from a face of the narrower rear section 222D to the other face of the narrower rear section 222D. A reinforcing guide slot 225D is defined in the narrower rear section 222D and communicated with the transverse through-hole 223D. Also, the reinforcing guide slot 225D extends from a face of the narrower rear section 222D to the other face of the narrower rear section 222D. The enclosed section 21D includes a shallow recess 211D in a front end thereof for filling plastic material into the narrower rear section 224D. The faces of the narrower rear section 222D are lower than those of the wider front section 221D, and two lateral sides of the narrower rear section 222D are lower than those of the wider front section 221D. Alternatively, the faces of the narrower rear section 222D are flush with those of the wider front section 221 D.

Figure 15:
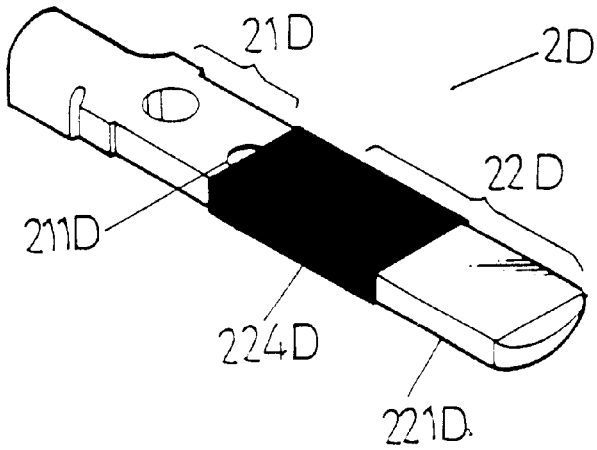
FIG. 15 is a perspective view of a plug blade made from the plug blade structure in accordance with the fifth embodiment, the plug blade having an insulating layer formed thereon.

An insulating layer 224D is formed on the narrower rear section 222D, as shown in FIG. 15. Formation of the insulating layer 224D and the subsequent housing 23 of the final plug is identical to that of the first embodiment with reference to FIGS. 24 through 26.

Figure 9:
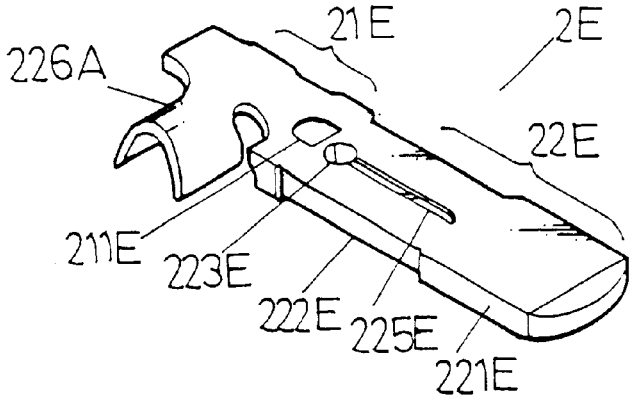
FIG. 9 is a perspective view of a plug blade structure in accordance with a sixth embodiment of the present invention.
Figure 22:
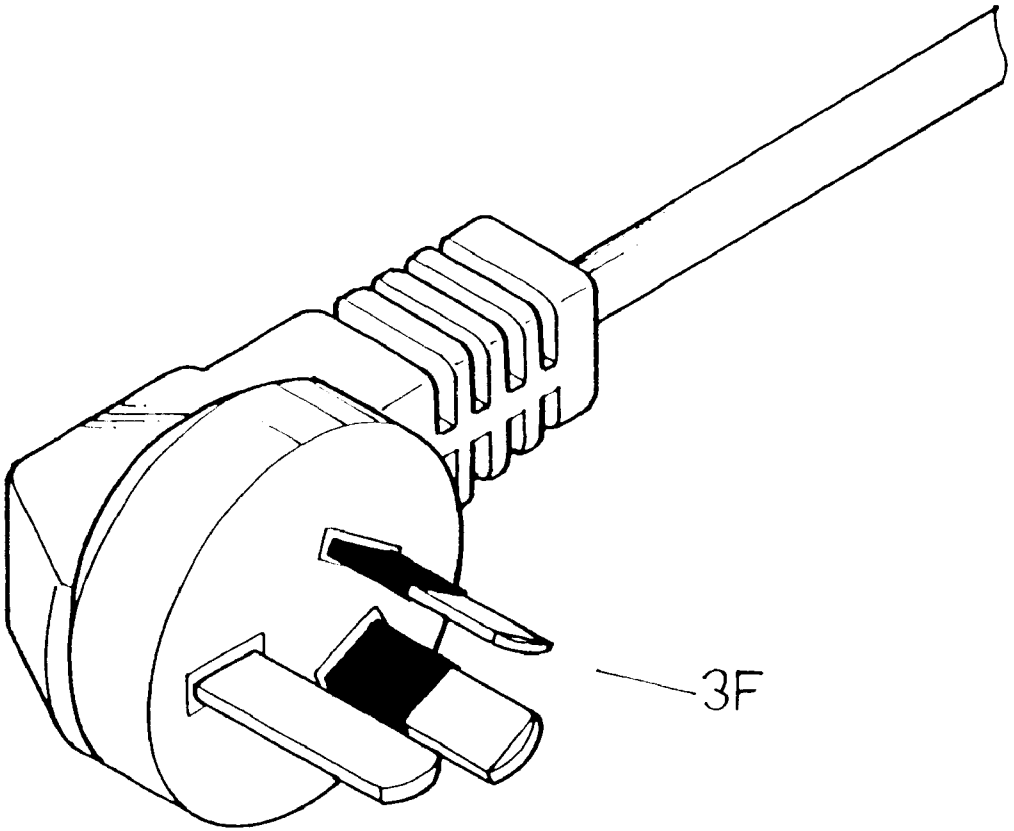
FIG. 22 is a perspective view of still another plug made from the plug blade structure in accordance with the present invention.
Figure 23:
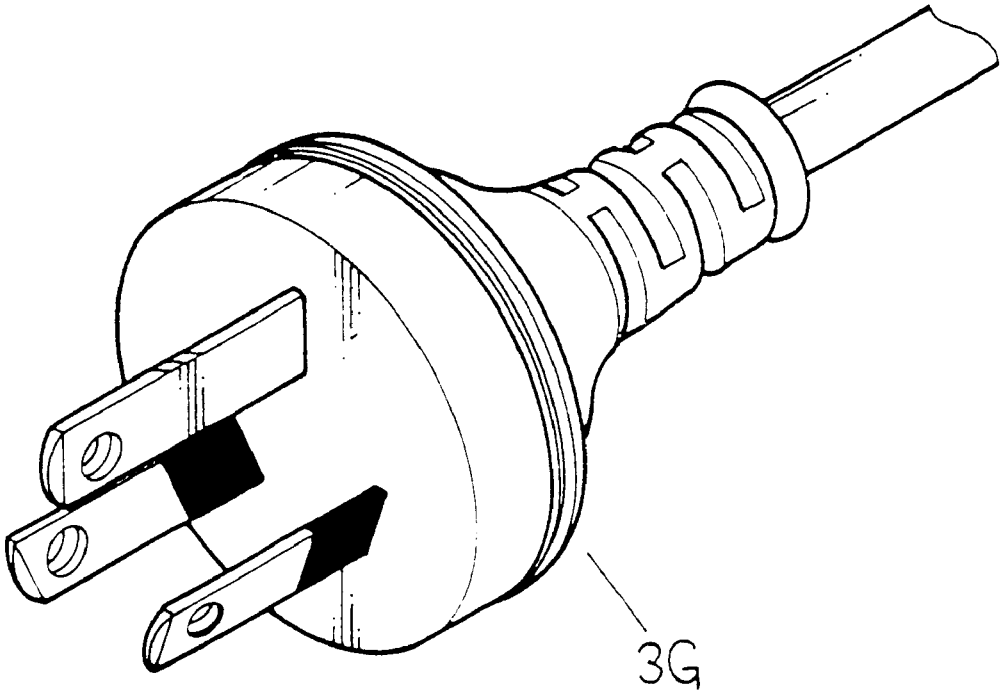
FIG. 23 is a perspective view of yet another plug made from the plug blade structure in accordance with the present invention.

FIG. 9 illustrates still another type of the plug blade structure 2E that is cut from a row of plug blades (not shown) and includes an enclosed section 21E to be enclosed by a housing of a plug and an exposed section 22E. In this embodiment, the plug blade structure 2E includes a wire-receiving groove 226A that is perpendicular to a longitudinal direction of the plug blade structure 2E for producing a plug 3F shown in FIG. 22.

The exposed section 22E includes a wider front section 221E and a narrower rear section 222E. A transverse through-hole 223E extends from a face of the narrower rear section 222E to the other face of the narrower rear section 222E. A reinforcing guide slot 225E is defined in the narrower rear section 222E and communicated with the transverse through-hole 223E. Also, the reinforcing guide slot 225E extends from a face of the narrower rear section 222E to the other face of the narrower rear section 222E. The enclosed section 21E includes a shallow recess 211E in a front end thereof for filling plastic material into the narrower rear section 224E. The faces of the narrower rear section 222E are lower than those of the wider front section 221E, and two lateral sides of the narrower rear section 222E are lower than those of the wider front section 221E. Alternatively, the faces of the narrower rear section 222E are flush with those of the wider front section 221E.

Figure 16:
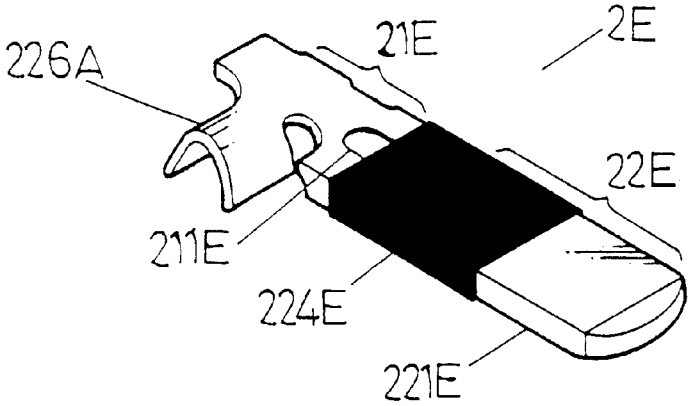
FIG. 16 is a perspective view of a plug blade made from the plug blade structure in accordance with the sixth embodiment, the plug blade having an insulating layer formed thereon.

An insulating layer 224E is formed on the narrower rear section 222E, as shown in FIG. 16. Formation of the insulating layer 224E and the subsequent housing 23 of the final plug is identical to that of the first embodiment with reference to FIGS. 24 through 26.

After formation of the housing 23, a plug 3A–3G shown in FIGS. 17–23 can be obtained according to need.

According to the above description, it is noted that the fault resulting from the formation of the insulating layer 220-220E is located in a position adjacent to the shallow recess 211-211E for filling the molten plastic material. Nevertheless, the shallow recess 211-211E is enclosed by the housing after formation of the whole plug 3A–3G. Thus, the appearance of the insulating layer 220-220E is not adversely affected. Further, due to provision of the reinforcing guide slot 225-225E communicated with the transverse through-hole 223-223E, the air on the faces of the metal blade can be well expelled to allow smooth injection of the molten plastic material, and the molten plastic material flowing randomly on the faces of the metal blades may flow from one face to the other of each metal blade. Thus, the thickness of the insulating layer is more uniform after formation. Further, the overall structure of the plug blade has appropriate rigidity from metal and appropriate softness from the plastic material, thereby having an optimal resistance to bending. The finally formed plugs 3A–3G meet requirements of different countries.

Although the invention has been explained in relation to its preferred embodiment, it is to be understood that many other possible modifications and variations can be made without departing from the scope of the invention as hereinafter claimed.

What is claimed is:

1. A plug blade structure comprising an enclosed section and an exposed section, said exposed section including a wider front section and a narrower rear section having a first face and a second face opposite to the first face, said enclosed section including a shallow recess in a front end thereof for filling molten plastic material into said narrower rear section, a transverse through-hole extending from said first face of said narrower rear section to said second face of said narrower rear section, a reinforcing guide slot being defined in said narrower rear section and communicating with said transverse through-hole, said reinforcing guide slot extending from said first face of said narrower rear section to said second face of said narrower rear section, said transverse through-hole and said reinforcing guide slot guiding the molten plastic material from said first face of said narrower rear section to said second face of said narrower rear section.

2. The plug blade as claimed in claim 1, wherein said shallow recess is semi-circular.

3. The plug blade as claimed in claim 1, wherein said shallow recess is rectangular.

* * * * *